US011807492B2

(12) United States Patent
Woo et al.

(10) Patent No.: US 11,807,492 B2
(45) Date of Patent: Nov. 7, 2023

(54) ALIGN MODULE OF MEDIUM DEPOSIT DEVICE

(71) Applicant: HYOSUNG TNS INC., Seoul (KR)

(72) Inventors: Hyun Sik Woo, Seoul (KR); Jae Hoon Kwak, Seoul (KR)

(73) Assignee: HYOSUNG TNS INC., Seoul (KR)

( * ) Notice: Subject to any disclaimer, the term of this patent is extended or adjusted under 35 U.S.C. 154(b) by 107 days.

(21) Appl. No.: 17/499,089

(22) Filed: Oct. 12, 2021

(65) Prior Publication Data

US 2022/0112043 A1 Apr. 14, 2022

(30) Foreign Application Priority Data

Oct. 13, 2020 (KR) ..... 10-2020-0131562

(51) Int. Cl.
*B65H 9/10* (2006.01)
*B65H 9/16* (2006.01)
*B65H 7/02* (2006.01)

(52) U.S. Cl.
CPC ..... *B65H 9/106* (2013.01); *B65H 7/02* (2013.01); *B65H 9/166* (2013.01); *B65H 2404/1441* (2013.01)

(58) Field of Classification Search
CPC . B65H 5/06; B65H 5/062; B65H 7/02; B65H 7/04; B65H 7/10; B65H 9/103;
(Continued)

(56) References Cited

U.S. PATENT DOCUMENTS 10,370,212 B1 * 8/2019 Atwood ..... B65H 9/106
2008/0296828 A1 * 12/2008 Shoji ..... B65H 9/10 271/10.12

(Continued)

FOREIGN PATENT DOCUMENTS

JP 2011 148617 A 8/2011
JP 2013 230905 A 11/2013
KR 10 2014 0037415 A 3/2014
WO 2018 207546 A1 11/2018

OTHER PUBLICATIONS

Office Action dated Mar. 17, 2022 issued in corresponding Korean application No. 10-2020-0131562.
Office Action dated Apr. 8, 2022 issued in corresponding GB application No. 2114371.4.

* cited by examiner

*Primary Examiner* — Prasad V Gokhale
(74) *Attorney, Agent, or Firm* — BACON & THOMAS, PLLC

(57) ABSTRACT

The present invention is directed to providing to an align module of a medium deposition device which is capable of reducing a time to align a medium and improving reliability of medium alignment and allows a structure of a device for the medium alignment to be simplified. In the present invention, to implement the objectives, the align module is provided between a separating unit configured to separate media input to a bundle module into individual sheets and a recognition module configured to discriminate information and authenticity of a deposited medium and includes a transfer roller which transfers the media passing through the separating unit, a first driving unit which drives the transfer roller to be moved upward, an alignment roller configured to move a medium to an alignment surface to align one side end of the medium with the alignment surface in a state in which the transfer roller is moved upward by the driving of the first driving unit, and a second driving unit which drives the alignment roller to be rotated.

7 Claims, 14 Drawing Sheets

(58) Field of Classification Search
CPC ..... B65H 9/106; B65H 2404/1112; B65H 2404/144; B65H 2404/1441; B65H 2701/1912
See application file for complete search history.

(56) References Cited

U.S. PATENT DOCUMENTS

2015/0284204 A1* 10/2015 Matsumoto ..... B65H 5/062
271/3.19
2018/0346271 A1* 12/2018 Nakamura ..... B65H 5/062

[FIG. 1]
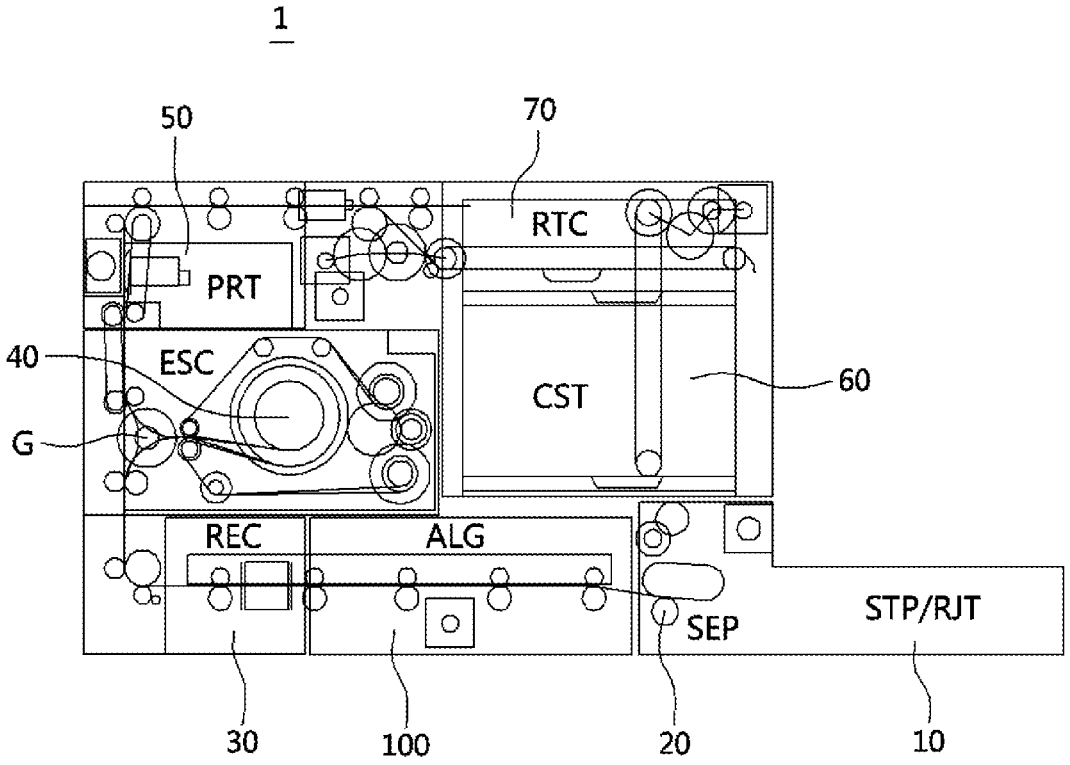

[FIG. 2]
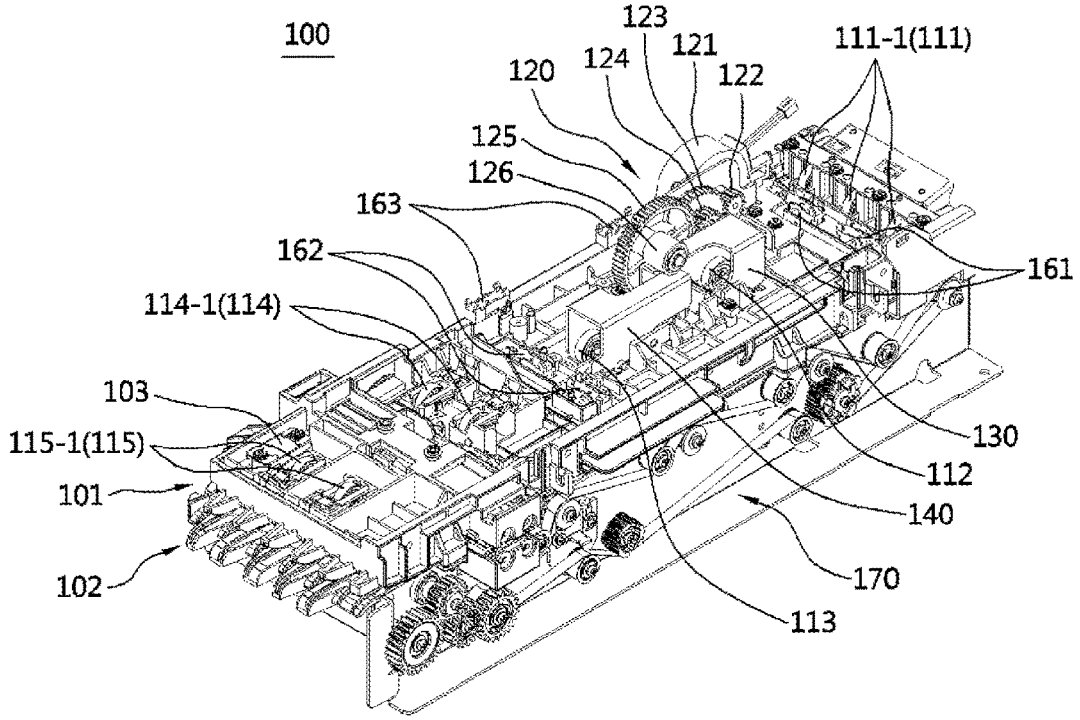
[FIG. 3]
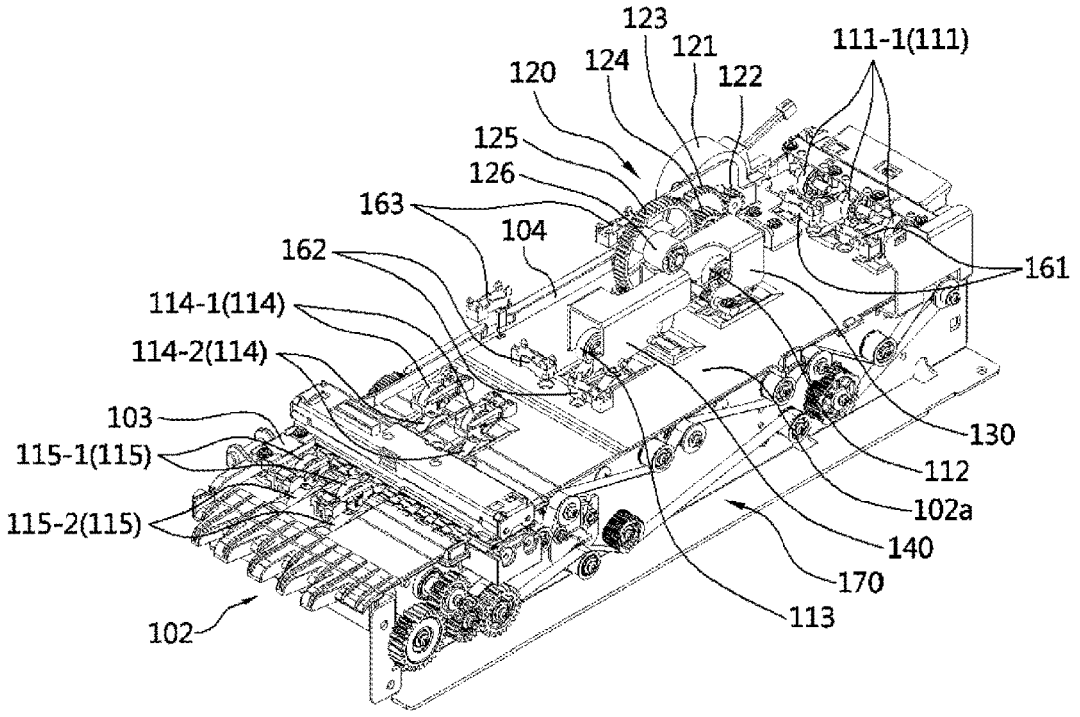

[FIG. 4]
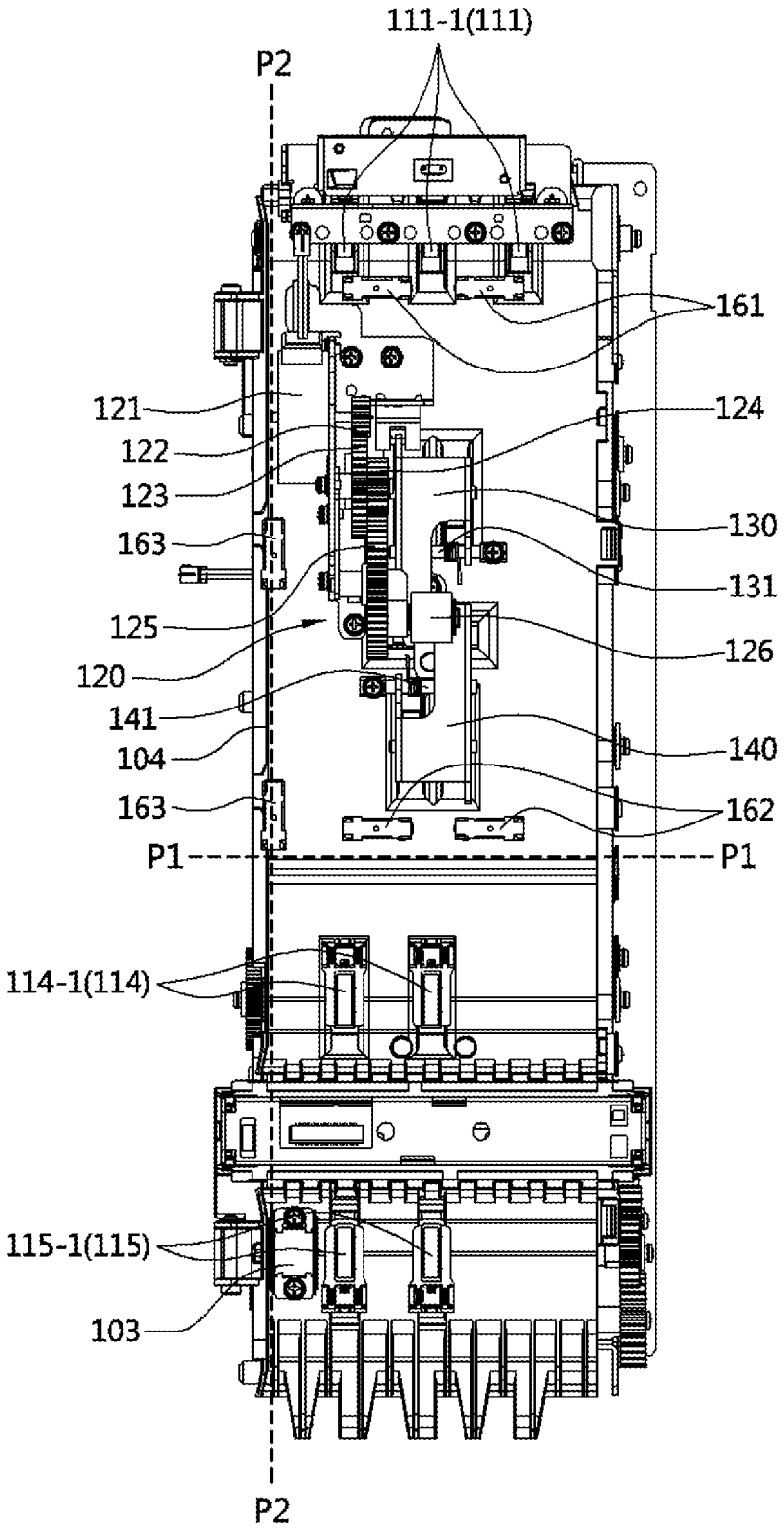

[FIG. 5]
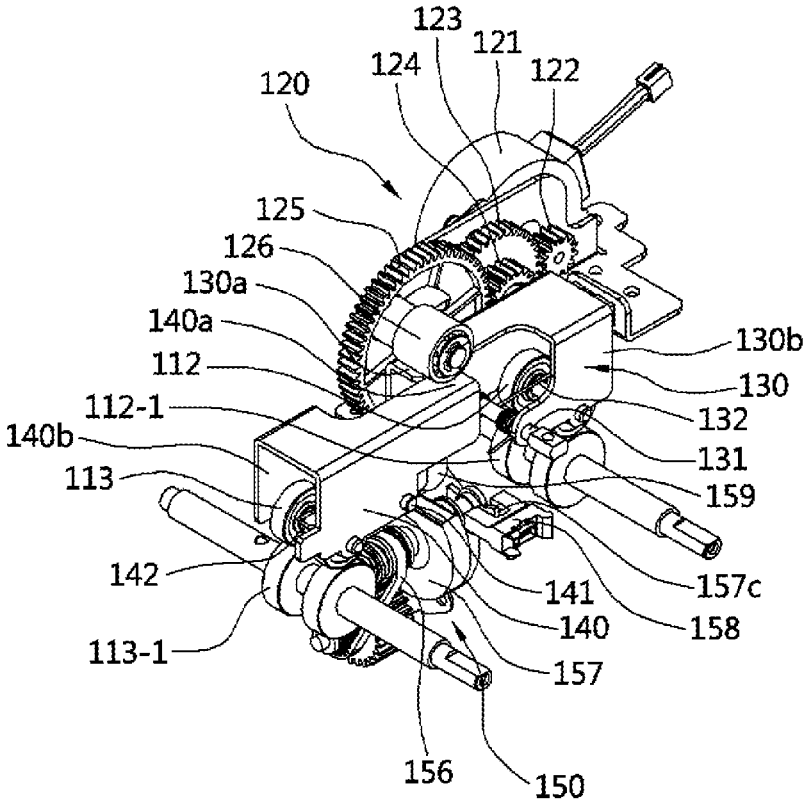

[FIG. 6]
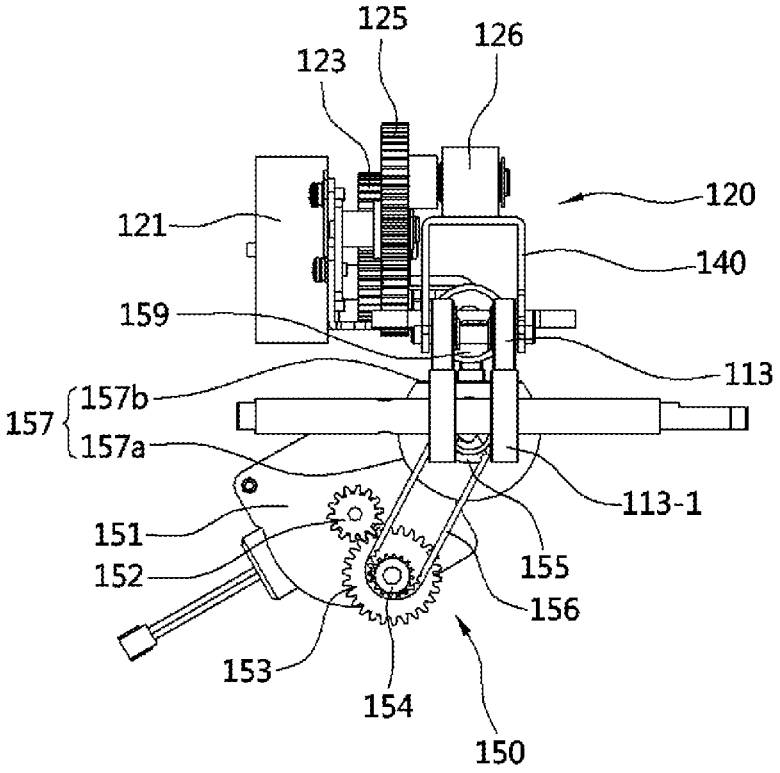

[FIG. 7]
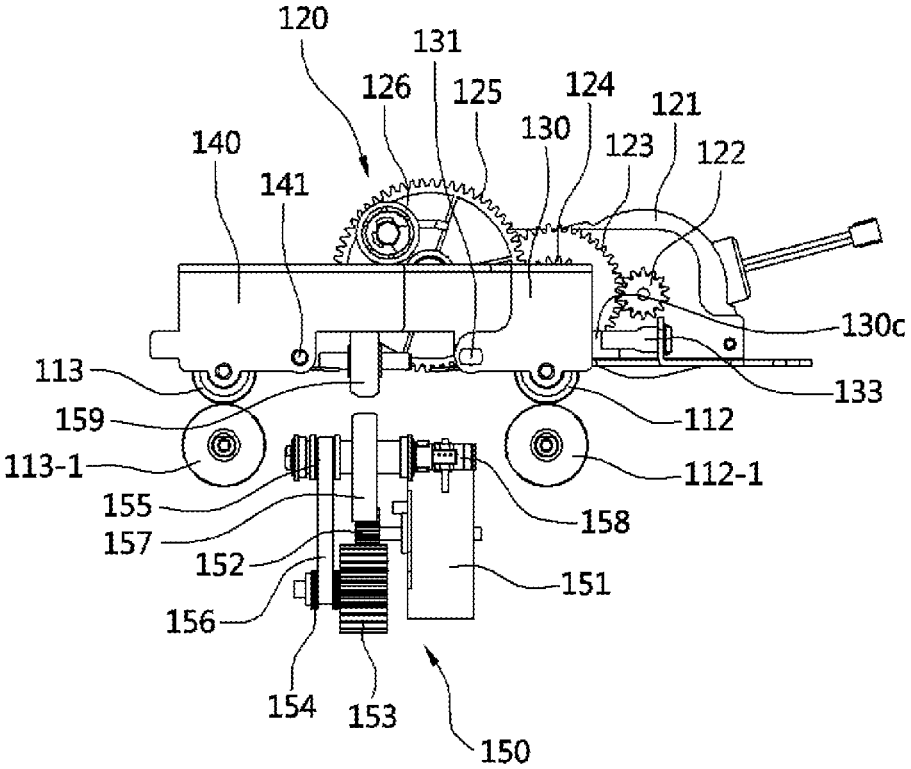

[FIG. 8]
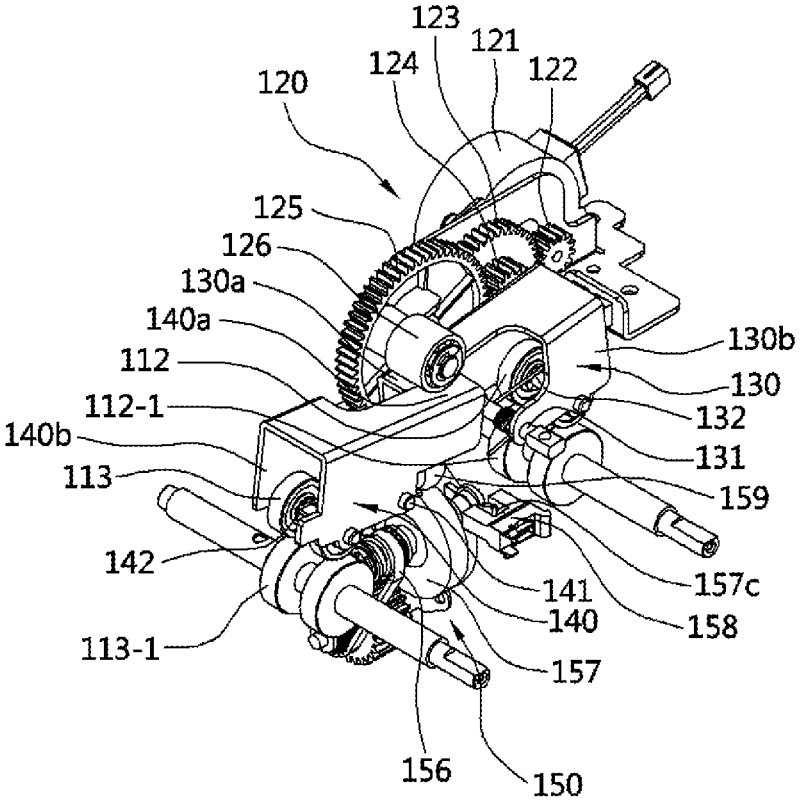

[FIG. 9]
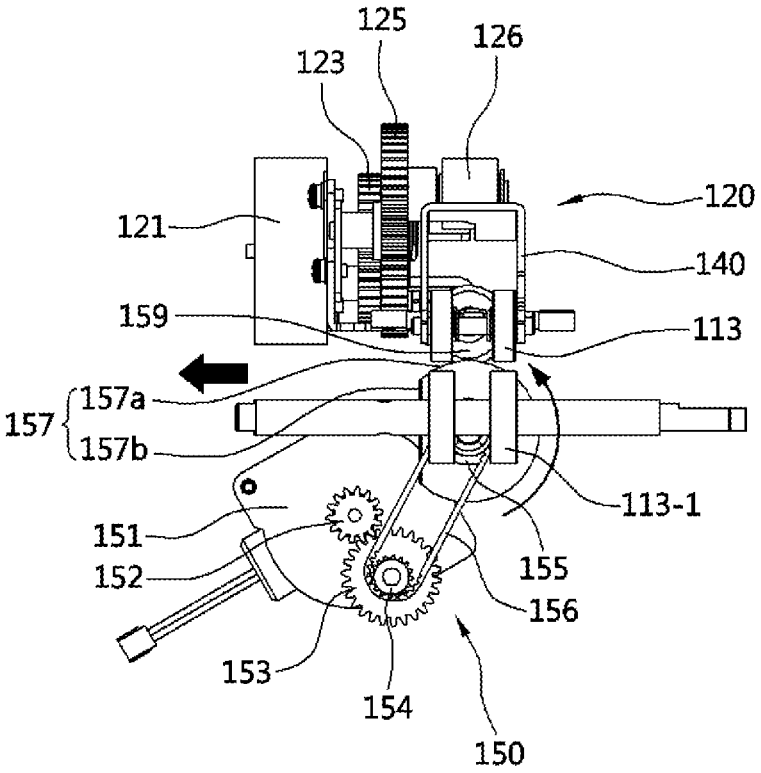

[FIG. 10]
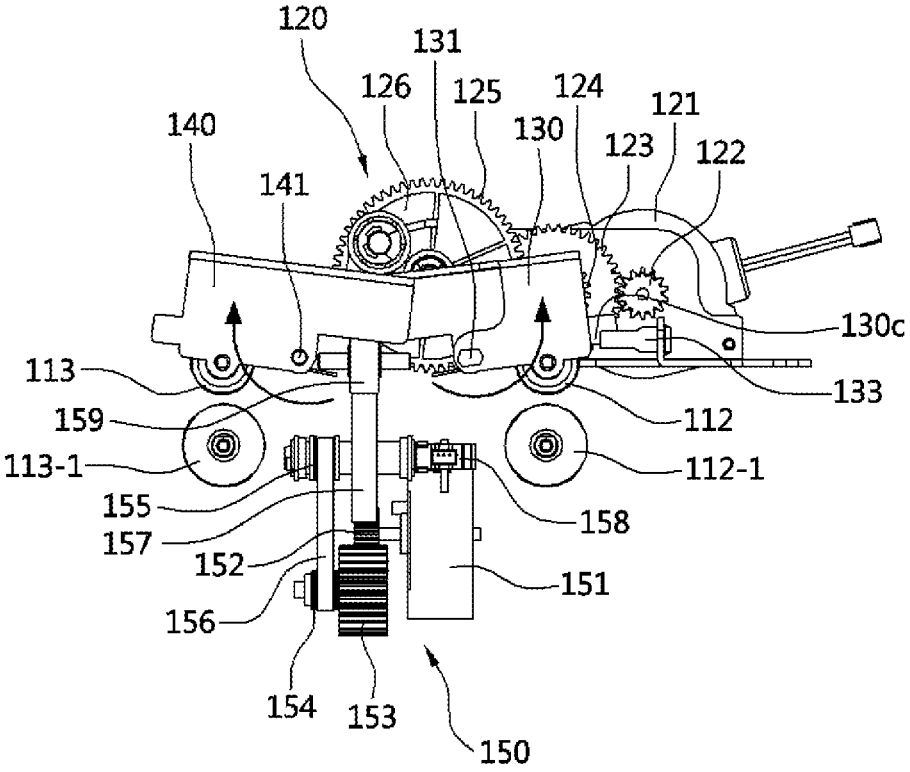

[FIG. 11]
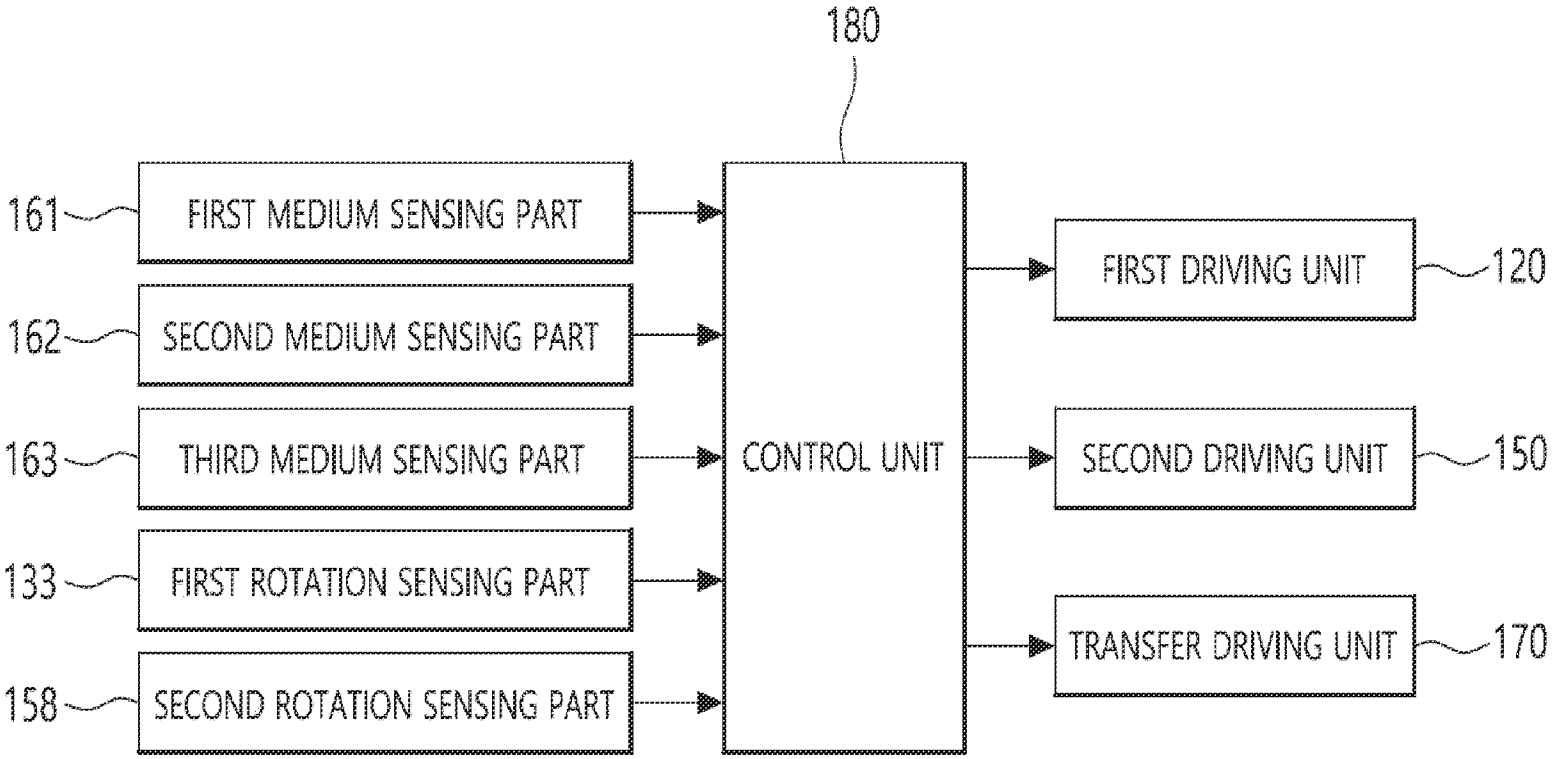

[FIG. 12]
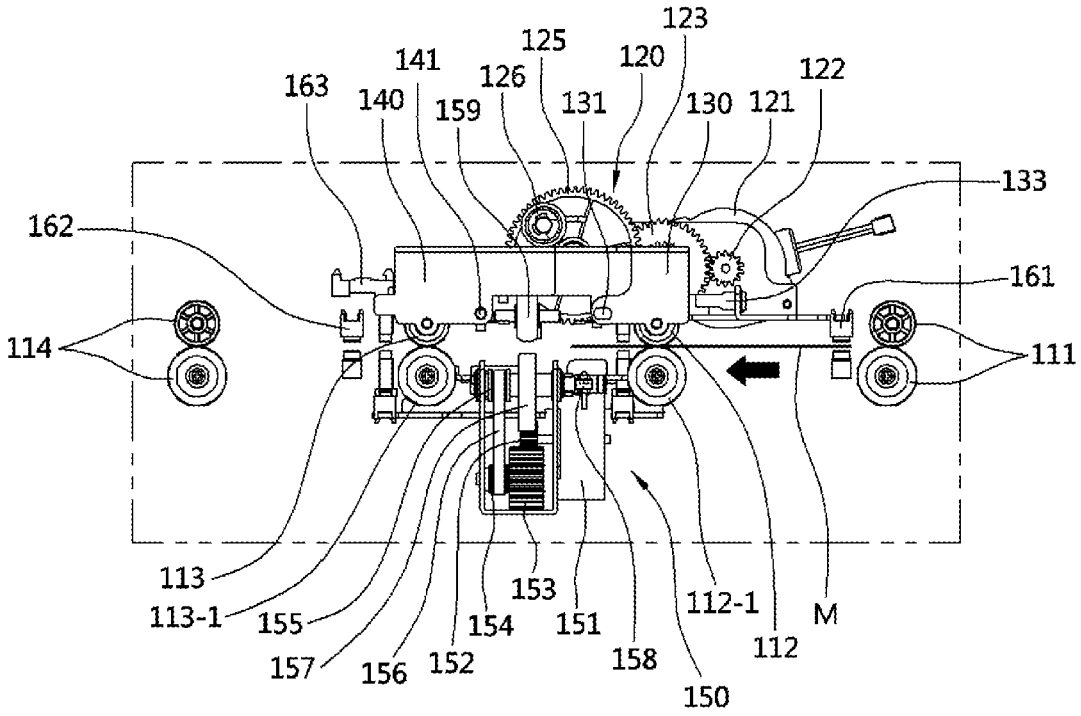
[FIG. 13]
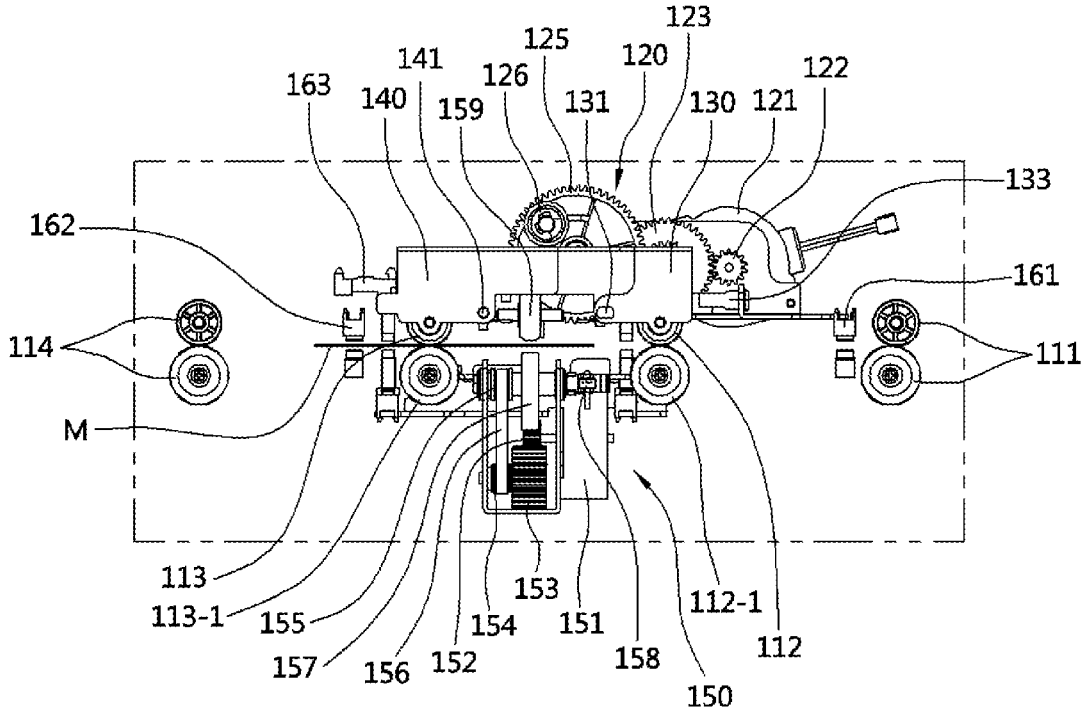

[FIG. 14]
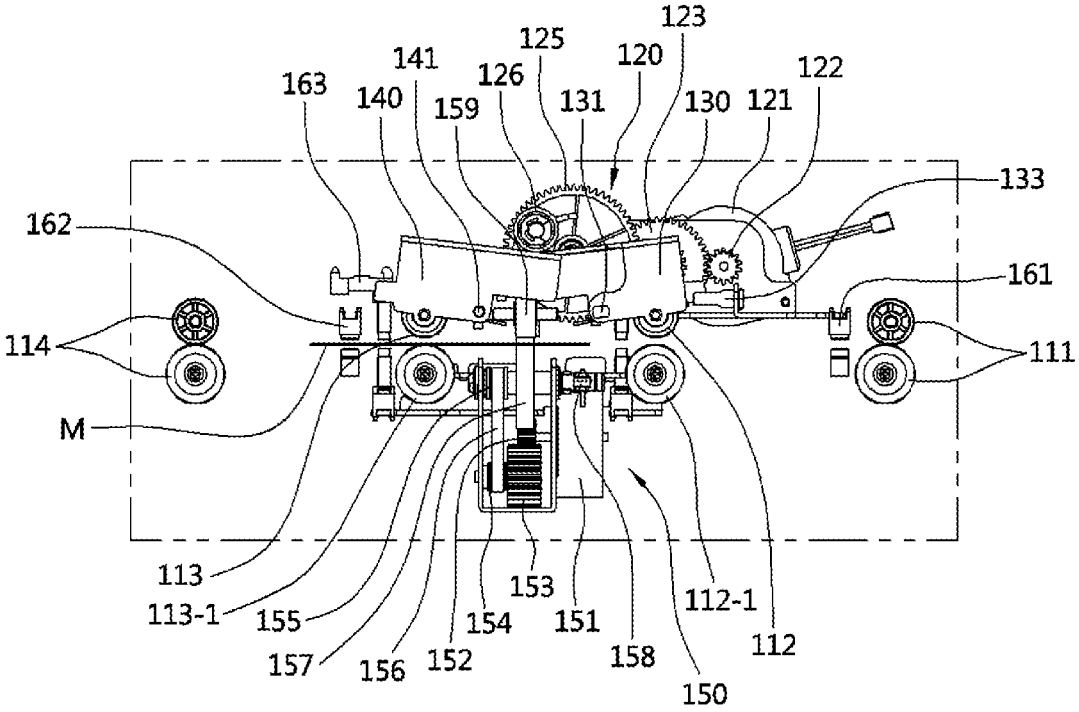

[FIG. 15]
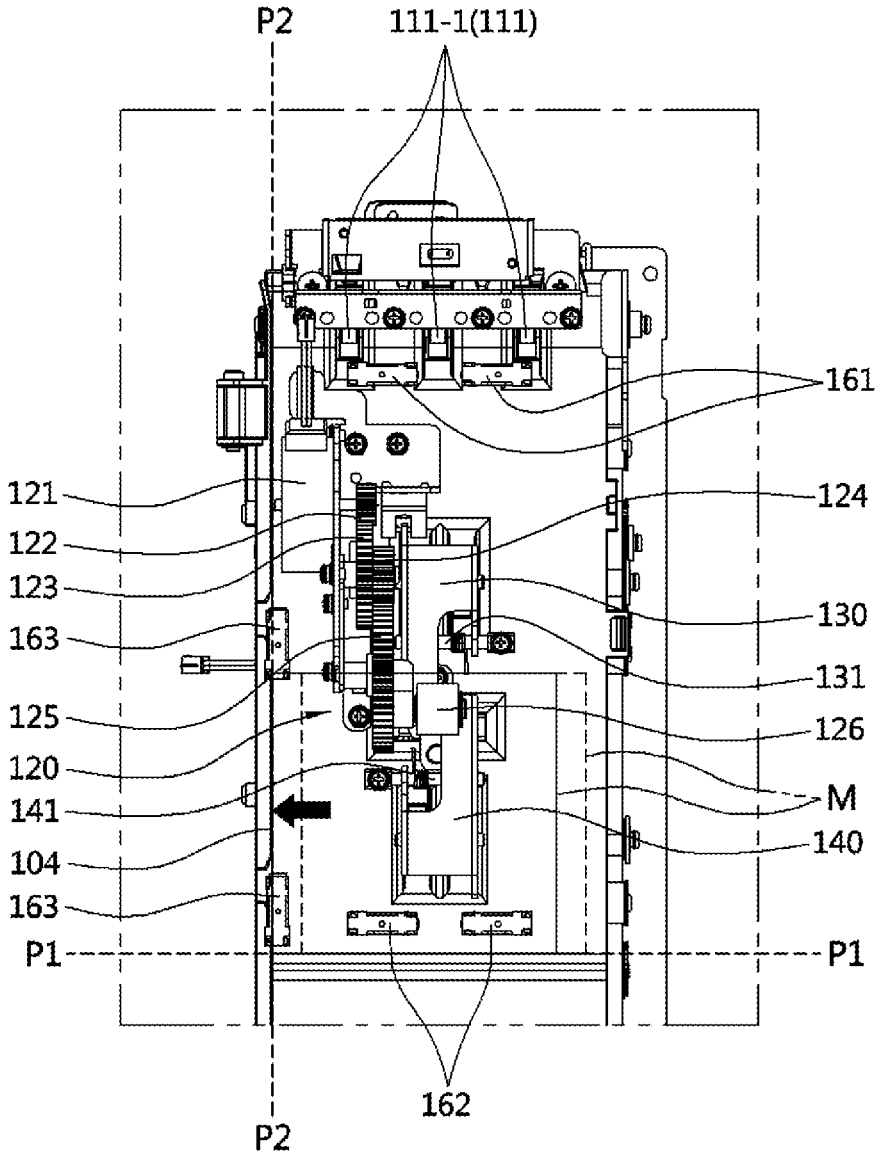

[FIG. 16]
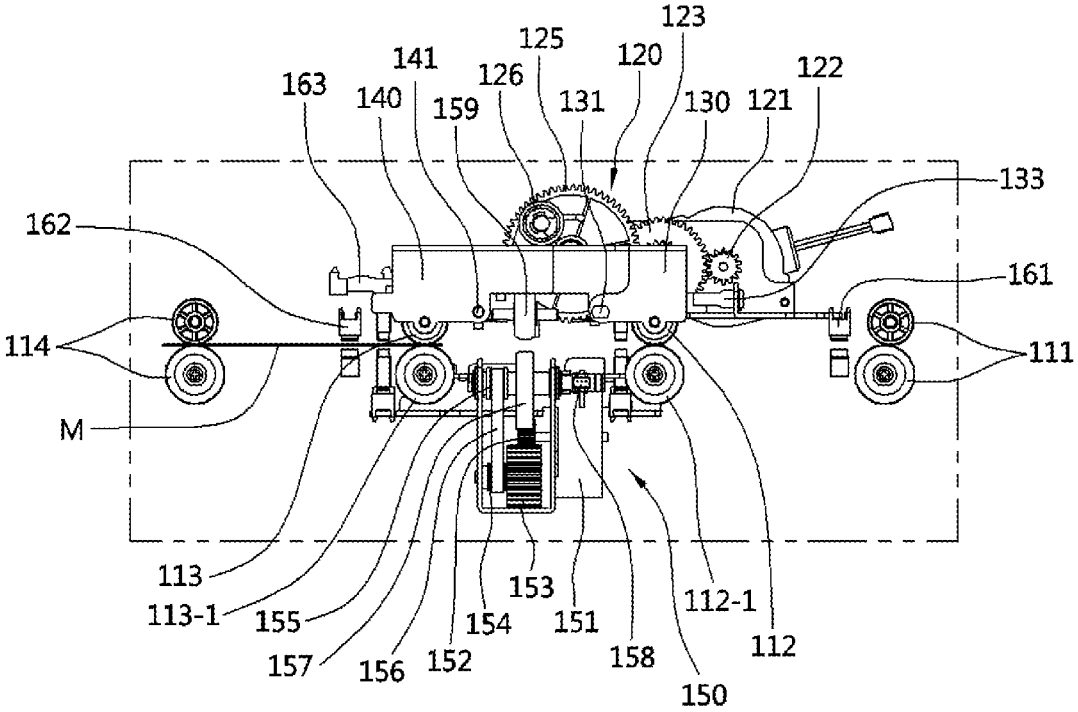

ALIGN MODULE OF MEDIUM DEPOSIT DEVICE

This application claims priority to and the benefit of Korean Patent Application No. 10-2020-0131562, filed on Oct. 13, 2020, the disclosure of which is incorporated herein by reference in its entirety.

BACKGROUND

1. Field of the Invention

The present invention relates to an align module of a medium deposition device, and more specifically, to an align module of a medium deposition device which has a function of moving a medium to a preset position and aligning the medium in order to recognize text of the medium.

2. Discussion of Related Art

Conventional automated teller machines are developed as machines which relate to unmanned financial services and are capable of quickly and conveniently providing most financial services excluding counseling services regardless of time, and the conventional automated teller machines include cash dispenser units (CDUs), bill recycling machines (BRMs), cash and check in modules (CCIMs) capable of performing processes of depositing and rejecting media such as a plurality of bills and checks in units of bundles at the same time, and the like.

The conventional medium deposition device includes a bundle module for inputting and receiving media in units of bundles, a separating unit for separating the media input to the bundle module into individual sheets, an align module which aligns a medium, which is inclined toward one side, of the media passing through the separating unit to be positioned parallel to a transfer direction, a discrimination unit for discriminating information and authenticity of the deposited media which pass through the align module and are transferred, a print module for printing necessary information relating to a deposited check, a cassette unit in which a medium, which is discriminated as a normal bill, of the deposited media by the discrimination unit is stored, and a reject module in which, among the deposited media, a medium discriminated as a rejected bill by the discrimination unit or a medium that is deposited and receipt-canceled is returned and stored and which returns the rejected bill to the bundle module in units of bundles.

Since the align module included in the conventional medium deposition device has a structure in which a medium is transferred in a step manner and aligned, there are problems in that it takes a long time to align the medium, and the structure of the align module for aligning the medium is complex.

The related art of the medium deposit device is disclosed in Korean Patent Registration No. 10-1183980.

SUMMARY OF THE INVENTION

The present invention is directed to providing to an align module of a medium deposition device which is capable of reducing a time to align a medium and improving reliability of medium alignment and allows a structure of a device for the medium alignment to be simplified.

According to an aspect of the present invention, there is provided an align module of a medium deposition, wherein the align module is provided between a separating unit configured to separate media input to a bundle module into individual sheets and a recognition module configured to discriminate information and authenticity of a deposited medium and includes a transfer roller which transfers the media passing through the separating unit, a first driving unit which drives the transfer roller to be moved upward, an alignment roller configured to move the medium to an alignment surface to align one side end of a medium with the alignment surface in a state in which the transfer roller is moved upward by the driving of the first driving unit, and a second driving unit which drives the alignment roller to be rotated.

The transfer roller may include a first transfer roller and a second transfer roller disposed to be spaced apart from each other in a transfer direction of the medium; and the transfer roller further includes: a first link member to which the first transfer roller is coupled and which is rotated about a first hinge part in upward and downward directions by the driving of the first driving unit; and a second link member to which the second transfer roller is coupled and which is rotated about a second hinge part in the upward and downward directions by the driving of the first driving unit.

The first driving unit may includes: a first driving motor; a driven gear which receives a driving force of the first driving motor to be rotated; and a pressing member which is coupled at an eccentric position with respect to a rotation center of the driven gear and moved upward or downward by the driving force of the first driving motor to press one side end of the first link member and the other side end of the second link member in the downward direction at the same time.

The first transfer roller may be coupled to the other side end of the first link member positioned at a side opposite to the one side end of the first link member; the first hinge part is provided between the one side end and the other side end of the first link member; the second transfer roller is coupled to one side end of the second link member positioned at a side opposite to the other side end of the second link member; and the second hinge part is provided between the one side end and the other side end of the second link member.

The alignment roller may include a partial section of an outer circumferential surface that is formed as a circular portion; and a remaining section excluding the circular portion of the outer circumferential surface that is formed as a linear portion.

A sandwich roller may be provided above the alignment roller; when the medium is transferred, the linear portion of the alignment roller is positioned at an upper side so that a space is provided between the alignment roller and the sandwich roller; and when the medium is aligned, the circular portion is positioned at the upper side so that the circular portion and the sandwich roller come into contact with each other.

A first medium sensing part which may be provided at an entrance side of the align module and detects whether the medium enters; a second medium sensing part which detects whether a leading end of the medium passing through the transfer roller arrives at a preset leading end position; a third medium sensing part which detects whether the one side end of the medium is aligned with the alignment surface by rotation-driving of the alignment roller; a transfer driving unit which is driven to transfer the medium in a transfer direction; and a control unit which controls the first driving unit, the second driving unit, and the transfer driving unit to be driven on the basis of signals detected by the first medium sensing part, the second medium sensing part, and the third medium sensing part.

The control unit may control the transfer driving unit to be stopped after the transfer driving unit is driven for a preset time from a time point at which it is detected by the first medium sensing part that a rear end of the medium has passed.

The control unit may control driving of the transfer driving unit to be stopped at a time point at which the second medium sensing part detects the medium; the transfer roller to be moved upward by driving of the first driving unit; and the alignment roller to protrude from a transfer surface for the medium and to be rotated by driving of the second driving unit when the transfer roller is moved upward so that the medium is transferred to the alignment surface.

When the medium is completely aligned, the control unit may control the alignment roller to escape to under the transfer surface for the medium through the driving of the second driving unit and controls the transfer roller to be moved downward by the driving of the first driving unit so that the medium is transferred by the driving of the transfer driving unit.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a schematic view illustrating a structure of a medium deposition device including an align module of the medium deposition device according to the present invention;

FIG. 2 is a perspective view illustrating the align module of the medium deposition device according to the present invention;

FIG. 3 is a perspective view illustrating main units of the align module of the medium deposition device according to the present invention;

FIG. 4 is a plan view of FIG. 3;

FIG. 5 is a perspective view illustrating a shape of a first driving unit included in the align module of the medium deposition device according to the present invention during a medium transfer operation;

FIG. 6 is a front view of FIG. 5;

FIG. 7 is a side view of FIG. 5;

FIG. 8 is a perspective view illustrating a shape of the first driving unit included in the align module of the medium deposition device according to the present invention during a medium alignment operation;

FIG. 9 is a front view of FIG. 8;

FIG. 10 is a side view of FIG. 8;

FIG. 11 is a control block diagram of the align module of the medium deposition device according to the present invention;

FIG. 12 is a side view illustrating a shape in which a rear end of the medium passes through a first medium sensing part;

FIG. 13 is a side view illustrating a shape in which a leading end of the medium is detected by a second medium sensing part and transfer of the medium is stopped;

FIG. 14 is a side view illustrating a shape in which a first transfer roller and a second transfer roller are moved upward by driving of the first driving unit in one direction;

FIG. 15 is a plan view illustrating a shape in which a side end of the medium is aligned by an alignment roller rotated by driving of the second driving unit; and FIG. 16 is a side view illustrating a shape in which the first transfer roller and the second transfer roller are moved downward and the medium is transferred by driving of the first driving unit in the opposite direction after the side end of the medium is aligned.

DETAILED DESCRIPTION OF EXEMPLARY EMBODIMENTS

Hereinafter, structures and operations of exemplary embodiments of the present invention will be described in detail with reference to the accompanying drawings.

First, a medium deposition device 1 including an align module 100 of a medium deposition device according to the present invention will be described with reference to FIG. 1.

The medium deposition device 1 to which the present invention is applied may include a bundle module 10 for inputting and receiving media in units of bundles, a separating unit 20 for separating the media input to the bundle module 10 into individual sheets, an align module 100 for aligning the media, which pass through the separating unit 20, with an exact position so that a recognition module 30 may recognize text, the recognition module 30 for discriminating information and authenticity of the deposited media, which pass through the align module 100 and are transferred, an escrow module 40 which temporarily stores media recognized as normal bills by the recognition module 30, a print module 50 for printing necessary information relating to the deposited medium, and a retract module 70 which stores a medium discriminated as a counterfeit bill by the recognition module 30 or medium returned to and not received by the bundle module 10.

Hereinafter, a structure and an operation of the align module 100 of the medium deposition device according to the present invention will be described with reference to FIGS. 2 to 16.

The align module 100 of the medium deposition device of the present invention is provided between the separating unit 20 for separating media M input to the bundle module 10 into individual sheets and the recognition module 30 for discriminating the information and authenticity of the deposited media M.

The align module 100 incudes transfer rollers 112 and 113 which transfer the media M passing through the separating unit 20, a first driving unit 120 which drives the transfer rollers 112 and 113 to be moved upward or downward, an alignment roller 157 for aligning one side end of the media M with an alignment surface 104 by moving the media M to the alignment surface 104 in a state in which the transfer rollers 112 and 113 are moved upward by driving of the first driving unit 120, and a second driving unit 150 which drives the alignment roller 157 to be rotated. The transfer rollers 112 and 113 include a first transfer roller 112 and a second transfer roller 113 disposed to be spaced apart from each other in a transfer direction of the media M.

The align module 100 includes an upper guide 101 and a lower guide 102. A medium is transferred through a space between the upper guide 101 and the lower guide 102, and an upper surface of the lower guide 102 is formed as the transfer surface 102*a* for the medium.

A plurality of pairs of entrance rollers 111 (111-1 and 111-2), which vertically circumscribe each other to transfer a medium which passes through the separating unit 20, are provided at an entrance side of the align module 100 to be spaced apart from each other in a lateral direction, and the align module 100 includes a first transfer roller 112, a first sandwich roller 112-1 disposed under the first transfer roller 112 to be spaced apart from the first transfer roller 112 by a predetermined distance, a second transfer roller 113, a second sandwich roller 113-1 provided under the second transfer roller 113, a pair of third transfer rollers 114 (114-1 and 114-2) which vertically circumscribe each other, and a pair of exit rollers 115 (115-1 and 115-2) which are provided at an exit side of the align module 100 and vertically circumscribe each other.

A text recognition unit (magnetic ink character recognition (MICR)) 103 for recognizing text printed on the medium M is provided at one side portion of a medium exit side of the upper guide 101.

The alignment of the medium M is to ensure that the text recognition unit 103 correctly recognizes the text printed on the medium M by moving the medium M so that the one side end of the media M is positioned on the alignment surface 104.

When a medium is transferred, the first transfer roller 112 and the second transfer roller 113 maintain a state in which a lower end of the first transfer roller 112 and a lower end of the second transfer roller 113 move downward to circumscribe an upper end of the first sandwich roller 112-1 and an upper end of the second sandwich roller 113-1, respectively, and when the medium M is aligned, the lower end of the first transfer roller 112 and the lower end of the second transfer roller 113 move upward to be spaced apart from the upper end of the first sandwich roller 112-1 and the upper end of the second sandwich roller 113-1, respectively, so that the medium M smoothly move to the alignment surface 104 without interference.

As components for moving the first transfer roller 112 and the second transfer roller 113 upward and downward, the align module 100 includes a first link member 130 coupled to the first transfer roller 112 and a second link member 140 coupled to the second transfer roller 113.

The first link member 130 is provided to rotate about a first hinge part 131 in the upward and downward directions, and the second link member 140 is provided to rotate about a second hinge part 141 in the upward and downward directions.

In the first link member 130, a first elastic member 132, which elastically supports the first transfer roller 112 in the downward direction, is provided, and in the second link member 140, a second elastic member 142, which elastically supports the second transfer roller 113 in the downward direction, is provided.

Accordingly, in a state in which an external force is not applied to the first link member 130 and the second link member 140 by a pressing member 126, due to elastic forces applied by the first elastic member 132 and the second elastic member 142, a state in which the first transfer roller 112 circumscribes the first sandwich roller 112-1 is maintained, a state in which the second transfer roller 113 circumscribes the second sandwich roller 113-1 is maintained, and thus the medium M is sandwiched between the first transfer roller 112 and the first sandwich roller 112-1 and between the second transfer roller 113 and the second sandwich roller 113-1 so that a state in which the media M is transferrable is maintained.

The first driving unit 120 is a unit to provide a driving force so as to move the first transfer roller 112 and the second transfer roller 113 in the upward and downward directions.

As one embodiment, the first driving unit 120 includes a pinion gear 122, a first gear 123, a second gear 124, and a driven gear 125 which are sequentially connected in a gear manner to transmit a driving force of the first driving motor 121 and a driving force of the first driving motor 121.

The pressing member 126 is coupled to the driven gear 125 at an eccentric position with respect to a rotation center of the driven gear 125 to protrude toward one side.

Accordingly, as illustrated in FIGS. 5 to 7, when the driven gear 125 rotates in one direction, the pressing member 126 moves in the upward direction, and as illustrated in FIGS. 8 to 10, when the driven gear 125 rotates in the opposite direction, the pressing member 126 moves in the downward direction.

One side end 130*a* of the first link member 130 and the other side end 140*a* of the second link member 140, each of which is in partial contact with the pressing member 126, are provided under the pressing member 126.

The first transfer roller 112 is coupled to the other side end 130*b* of the first link member 130 positioned at a side opposite to the one side end 130*a* of the first link member 130, and the first hinge part 131 is provided between the one side end 130*a* and the other side end 130*b* of the first link member 130.

The second transfer roller 113 is coupled to one side end 140*b* of the second link member 140 positioned at a side opposite to the other side end 140*a* of the second link member 140, and the second hinge part 141 is provided between the one side end 140*b* and the other side end 140*a* of the second link member.

When the first driving motor 121 rotates in one direction, each of the first link member 130 and the second link member 140 maintains a horizontal state, and in this case, a state in which the first transfer roller 112 is in contact with the first sandwich roller 112-1 positioned under the first transfer roller 112 is maintained, and a state in which the second transfer roller 113 is in contact with the second sandwich roller 113-1 positioned under the second transfer roller 113 is maintained.

When the first driving motor 121 is driven in the opposite direction, the pressing member 126 pushes the one side end 130*a* of the first link member 130 and the other side end 140*a* of the second link member 140 in the downward direction at the same time.

In this case, the first link member 130 rotates about the first hinge part 131, the other side end 130*b* of the first link member 130 and the first transfer roller 112 coupled to the first link member 130 move upward, and thus a space is provided between the first transfer roller 112 and the first sandwich roller 112-1 which are separated apart from each other. At the same time, the second link member 140 rotates about the second hinge part 141, the one side end 140*b* of the second link member 140 and the second transfer roller 113 coupled to the second link member 140 move upward, and thus a space is provided between the second transfer roller 113 and the second sandwich roller 113-1 which are separated apart from each other.

As described above, when the first link member 130 and the second link member 140 rotate and when the first transfer roller 112 and the second transfer roller 113 are moved upward by pressing the pressing member 126 in the downward direction, the medium M may be moved to the alignment surface 104 without interference.

Meanwhile, a sensing target part 130*c* formed to protrude from one side portion of the first link member 130, and a first rotation sensing part 133 for detecting a position at which the sensing target part 130*c* is rotated may be provided on the one side portion of the first link member 130. A control unit 180 may control a driving state of the first driving motor 121 on the basis of a signal detected by the first rotation sensing part 133.

As components for transferring the medium M to the alignment surface 104, a sandwich roller 159 is provided between the first transfer roller 112 and the second transfer roller 113, the alignment roller 157, which comes into contact with or is separated from the sandwich roller 159 according to a rotation state, is disposed under the sandwich roller 159, and the second driving unit 150 for driving the alignment roller 157 to be rotated is provided.

In the alignment roller 157, a partial section of an outer circumferential surface thereof is formed as a circular portion 157*a*, and the remaining section excluding the circular portion 157*a* of the outer circumferential surface is formed as a linear portion 157*b* so that the alignment roller 157 is formed in substantially a "D" shape when viewed from the front.

Referring to FIGS. 5 to 7, when the medium M is transferred, the alignment roller 157 is in an avoidance state in which the linear portion 157*b* is positioned at an upper side so that a space is provided between the linear portion 157*b* and the sandwich roller 159 which are spaced apart from each other, and transfer of the medium M is not interfered with. In this case, the linear portion 157*b* is positioned under the transfer surface 102*a* for the medium.

Referring to FIGS. 8 to 10, when the media M is aligned, the circular portion 157*a* of the alignment roller 157 is positioned at the upper side, and the circular portion 157*a* and the sandwich roller 159 come into contact with each other. In this case, the circular portion 157*a* protrudes from the transfer surface 102*a* for the medium and rotates in a state in which the circular portion 157*a* is in contact with the sandwich roller 159 to move the medium M sandwiched between the circular portion 157*a* and the sandwich roller 159 to the alignment surface 104.

The second driving unit 150 is a unit for driving the alignment roller 157 to be rotated. As one embodiment, the second driving unit 150 may include a second driving motor 151, a pinion gear 152 coupled to a rotation shaft of the second driving motor 151, a connection gear 153 connected to one side of the pinion gear 152 in a gear manner, a first pulley 154 coaxially coupled to the connection gear 153, a second pulley 155 coaxially coupled to the alignment roller 157, and a belt 156 which is disposed between the first pulley 154 and the second pulley 155 and transmits power thereto.

Meanwhile, a sensing target part 157*c* may be formed to protrude from one side of a rotation shaft coupled to the alignment roller 157, and a second rotation sensing part 158 for detecting a position at which the sensing target part 157*c* is rotated may be provided on the one side of the rotation shaft. The control unit 180 may control a driving state of the second driving motor 151 on the basis of a signal detected by the second rotation sensing part 158.

Meanwhile, referring to FIGS. 2 to 4 and 11, the align module 100 may further include a first medium sensing part 161 provided at the entrance side of the align module 100 to detect whether the medium enters, a second medium sensing part 162 which detects whether a leading end of the medium M arrives at a preset leading end position P1 in order to align the medium M, a third medium sensing part 163 which detects whether the one side end of the medium M arrives at a preset side end position P2, that is, the alignment surface 104, by rotation-driving of the alignment roller 157, a transfer driving unit 170 which drives so that the medium M is transferred in the transfer direction, and the control unit 180 which controls the first driving unit 120, the second driving unit 150, and the transfer driving unit 170 to be driven on the basis of signals detected by the first medium sensing part 161, the second medium sensing part 162, and the third medium sensing part 163.

Hereinafter, a process in which a side end of the medium M is aligned and an operation of the control unit 180 in the align module 100 of the medium deposition device of the present invention will be described with reference to FIGS. 12 to 16. First, as shown in FIG. 12, the medium M enters an entrance of the align module 100, and a rear end of the medium M is detected by the first medium sensing part 161.

In this case, the control unit 180 may control the transfer driving unit 170 to be stopped after the transfer driving unit 170 is driven for a preset time from a time point at which it is detected by the first medium sensing part 161 that the rear end of the medium has passed.

FIG. 13 is a view illustrating a state in which the medium M sequentially passes between the first transfer roller 112 and the first sandwich roller 112-1 and between the second transfer roller 113 and the second sandwich roller 113-1, and the medium M is stopped at a position at which the second medium sensing part 162 detects the leading end of the medium M.

In this case, the control unit 180 controls driving of the transfer driving unit 170 to be stopped at a time point at which the second medium sensing part 162 detects the medium M.

When the driving of the transfer driving unit 170 is stopped, as shown in FIG. 14, the control unit 180 drives the first driving unit 120 to control the transfer rollers 112 and 113 to be moved upward.

When the transfer rollers 112 and 113 are moved upward, as illustrated in FIG. 15, the control unit 180 controls the circular portion 157*a* of the alignment roller 157 to protrude from the transfer surface 102*a* for the media M using driving of the second driving unit 150 so as to move the medium M to the alignment surface 104 and align the medium M with the exact position P2.

When the medium M is completely aligned, as illustrated in FIG. 16, the control unit 180 controls the linear portion 157*b* of the alignment roller 157 to be positioned at the upper side so that the alignment roller 157 escapes to under the transfer surface 102*a* for the medium by the driving of the second driving unit 150 and controls the transfer rollers 112 and 113 to be moved downward by driving of the first driving unit 120 so that the medium M is transferred again by driving of the transfer driving unit 170.

According to an align module of a medium deposition device according to the present invention, in a state in which a transfer roller is moved upward by driving of a first driving unit, since one side end of a medium is aligned to be positioned on an alignment surface by rotating an alignment roller through driving of a second driving unit, a time to align the medium can be reduced, reliability of medium alignment can be improved, and a structure of a device for the medium alignment can be simplified.

As described above, the present invention is not limited to the above-described embodiment, and modified embodiments may be clearly made by those skilled in the art without departing from the technical spirit of the present invention claimed by the claims, and such modified embodiments fall within the range of the present invention.

What is claimed is:

1. An align module of a medium deposition device, which is provided between a separating unit configured to separate media input to a bundle module into individual sheets and a recognition module configured to discriminate information and authenticity of a deposited medium, the align module comprising:

a transfer roller which transfers the media passing through the separating unit;

a first driving unit which drives the transfer roller to be moved upward;

an alignment roller configured to move a medium to an alignment surface to align one side end of the medium with the alignment surface in a state in which the transfer roller is moved upward by the driving of the first driving unit; and a second driving unit which drives the alignment roller to be rotated;

wherein:

the transfer roller includes a first transfer roller and a second transfer roller disposed to be spaced apart from each other in a transfer direction of the medium; and the transfer roller further includes:

a first link member to which the first transfer roller is coupled and which is rotated about a first hinge part in upward and downward directions by the driving of the first driving unit; and a second link member to which the second transfer roller is coupled and which is rotated about a second hinge part in the upward and downward directions by the driving of the first driving unit; and the first driving unit includes:

a first driving motor;

a driven gear which receives a driving force of the first driving motor to be rotated; and a pressing member which is coupled at an eccentric position with respect to a rotation center of the driven gear and moved upward or downward by the driving force of the first driving motor to press one side end of the first link member and the other side end of the second link member in the downward direction at the same time.

2. The align module of claim 1, wherein:

the first transfer roller is coupled to the other side end of the first link member positioned at a side opposite to the one side end of the first link member;

the first hinge part is provided between the one side end and the other side end of the first link member;

the second transfer roller is coupled to one side end of the second link member positioned at a side opposite to the other side end of the second link member; and the second hinge part is provided between the one side end and the other side end of the second link member.

3. An align module of a medium deposition device, which is provided between a separating unit configured to separate media input to a bundle module into individual sheets and a recognition module configured to discriminate information and authenticity of a deposited medium, the align module comprising:

a transfer roller which transfers the media passing through the separating unit;

a first driving unit which drives the transfer roller to be moved upward;

an alignment roller configured to move a medium to an alignment surface to align one side end of the medium with the alignment surface in a state in which the transfer roller is moved upward by the driving of the first driving unit; and a second driving unit which drives the alignment roller to be rotated;

wherein, the alignment roller includes:

a partial section of an outer circumferential surface that is formed as a circular portion; and a remaining section excluding the circular portion of the outer circumferential surface that is formed as a linear portion.

4. The align module of claim 3, wherein:

a sandwich roller is provided above the alignment roller;

when the medium is transferred, the linear portion of the alignment roller is positioned at an upper side so that a space is provided between the alignment roller and the sandwich roller; and when the medium is aligned, the circular portion is positioned at the upper side so that the circular portion and the sandwich roller come into contact with each other.

5. An align module of a medium deposition device, which is provided between a separating unit configured to separate media input to a bundle module into individual sheets and a recognition module configured to discriminate information and authenticity of a deposited medium, the align module comprising:

a transfer roller which transfers the media passing through the separating unit;

a first driving unit which drives the transfer roller to be moved upward;

an alignment roller configured to move a medium to an alignment surface to align one side end of the medium with the alignment surface in a state in which the transfer roller is moved upward by the driving of the first driving unit;

a second driving unit which drives the alignment roller to be rotated;

a first medium sensing part which is provided at an entrance side of the align module and detects whether the medium enters;

a second medium sensing part which detects whether a leading end of the medium passing through the transfer roller arrives at a preset leading end position;

a third medium sensing part which detects whether the one side end of the medium is aligned with the alignment surface by rotation-driving of the alignment roller;

a transfer driving unit which is driven to transfer the medium in a transfer direction; and a control unit which controls the first driving unit, the second driving unit, and the transfer driving unit to be driven on the basis of signals detected by the first medium sensing part, the second medium sensing part, and the third medium sensing part;

wherein: the control unit controls the transfer driving unit to be stopped after the transfer driving unit is driven for a preset time from a time point at which it is detected by the first medium sensing part that a rear end of the medium has passed.

6. The align module of claim 5, wherein the control unit controls:

driving of the transfer driving unit to be stopped at a time point at which the second medium sensing part detects the medium;

the transfer roller to be moved upward by driving of the first driving unit; and the alignment roller to protrude from a transfer surface for the medium and to be rotated by driving of the second driving unit when the transfer roller is moved upward so that the medium is transferred to the alignment surface.

7. The align module of claim 6, wherein, when the medium is completely aligned, the control unit controls the alignment roller to escape to under the transfer surface for the medium through the driving of the second driving unit and controls the transfer roller to be moved downward by the driving of the first driving unit so that the medium is transferred by the driving of the transfer driving unit.

* * * * *